United States Patent [19]

Grise

[11] Patent Number: 4,523,085

[45] Date of Patent: Jun. 11, 1985

[54] ELECTRICAL HEATING DEVICE

[75] Inventor: Frederick G. J. Grise, Osterville, Mass.

[73] Assignee: Flexwatt Corporation, Canton, Mass.

[21] Appl. No.: 572,678

[22] Filed: Jan. 20, 1984

Related U.S. Application Data

[63] Continuation-in-part of Ser. No. 295,000, Aug. 21, 1981, Pat. No. 4,485,297, which is a continuation-in-part of Ser. No. 181,074, Aug. 28, 1980, abandoned.

[51] Int. Cl.[3] ..... H05B 3/34

[52] U.S. Cl. ..... 219/528; 174/68.5; 174/117 FF; 219/345; 219/541; 219/543; 219/549; 338/212; 338/314; 338/328

[58] Field of Search ..... 219/203, 301, 345, 522, 219/528, 529, 541, 543, 544, 548, 549, 552, 553; 338/210, 211, 212, 217, 293, 300, 314, 308, 309, 319, 320, 323, 324, 328, 330; 174/68.5, 117 FF; 339/61

[56] References Cited

U.S. PATENT DOCUMENTS

| | | | |
|---|---|---|---|
| 2,473,183 | 6/1949 | Watson | 219/543 |
| 2,489,643 | 11/1949 | Hunter | 338/212 X |
| 2,559,077 | 7/1951 | Johnson et al. | 219/543 |
| 2,575,987 | 11/1951 | York et al. | 219/528 |
| 2,641,675 | 6/1953 | Hannahs | 219/543 X |
| 2,782,289 | 2/1957 | Nathanson | 219/528 X |
| 2,973,502 | 2/1961 | Tally | 174/117 FF |
| 3,010,007 | 11/1961 | Theodore et al. | 338/210 X |
| 3,153,140 | 10/1964 | Theodore et al. | 219/549 |
| 3,168,617 | 2/1965 | Richter | 219/549 X |
| 3,277,419 | 10/1966 | Butz | 338/314 |
| 3,757,087 | 9/1973 | Bernard | 219/549 |
| 3,878,362 | 4/1975 | Stinger | 219/528 |
| 4,029,942 | 6/1977 | Levin | 219/522 |
| 4,197,449 | 4/1980 | Fessenden | 219/549 |
| 4,213,028 | 7/1980 | Wolf | 338/314 X |
| 4,250,398 | 2/1981 | Ellis et al. | 219/345 |
| 4,429,216 | 1/1984 | Brigham | 219/528 |

FOREIGN PATENT DOCUMENTS

| | | | |
|---|---|---|---|
| 2616855 | 11/1977 | Fed. Rep. of Germany | 219/528 |
| WO82/00935 | 3/1982 | PCT Int'l Appl. | 219/528 |
| 491576 | 7/1970 | Switzerland . | |

*Primary Examiner*—Volodymyr Y. Mayewsky

[57] ABSTRACT

An electrical heating device comprises a substrate, an elongated conductor extending longitudinally of the substrate, a semi-conductor pattern carried on the substrate and electrically connected to and extending from the conductor pair, and a sealing layer overlying the conductor and sealed to the substrate at opposite sides of the conductor. The conductor comprises a pair of rectangular in cross-section metallic conductor elements, placed one on top of the other in face-to-face engagement with and unattached to each other. The bottom conductor elements faces towards the substrate and the upper conductor elements faces towards and engaging the sealing layer. Adjacent one end of the device, the upper conductor elements is folded back longitudinally upon itself to expose an upper surface of the lower conductor element and a lower surface of the upper conductor element, and wherein a wire engages and is electrically connected to the thus exposed upper surface of said lower conductor element and the thus exposed lower surface of said upper conductor element.

14 Claims, 4 Drawing Figures

FIG 1
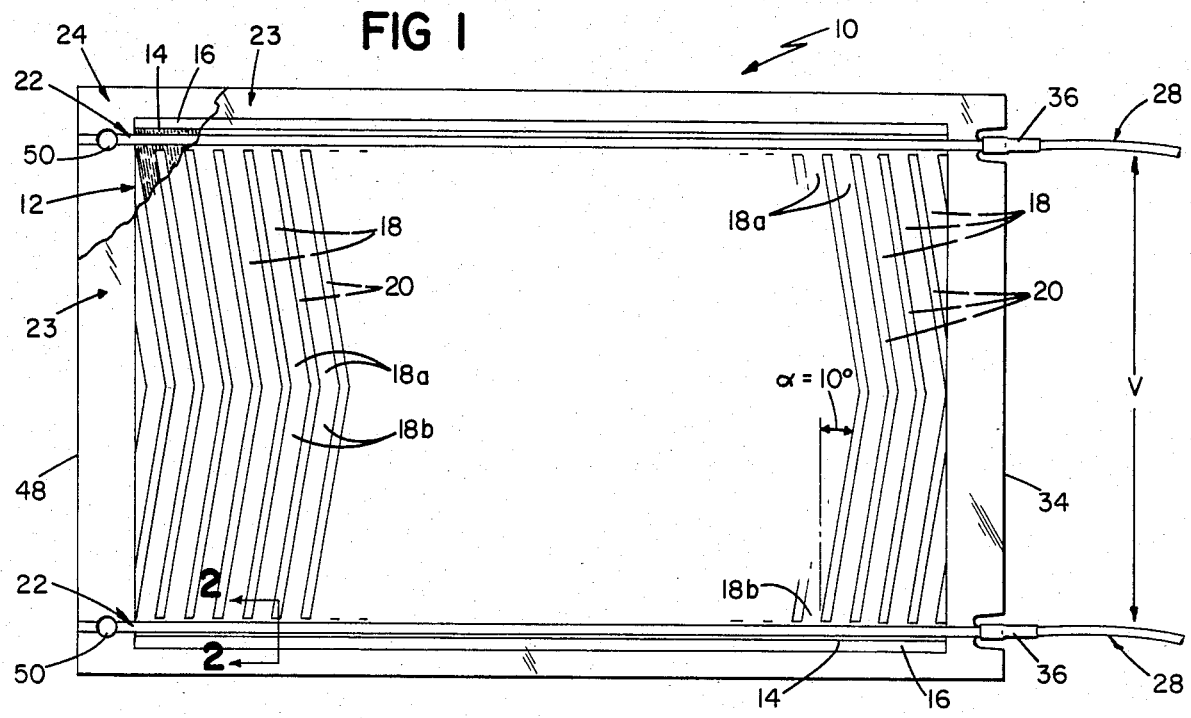
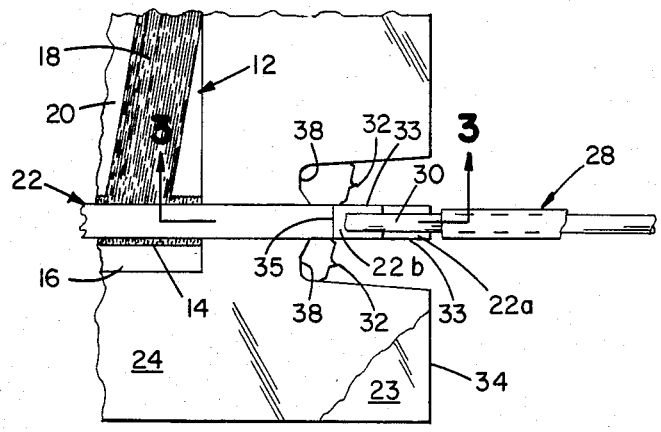
FIG 4
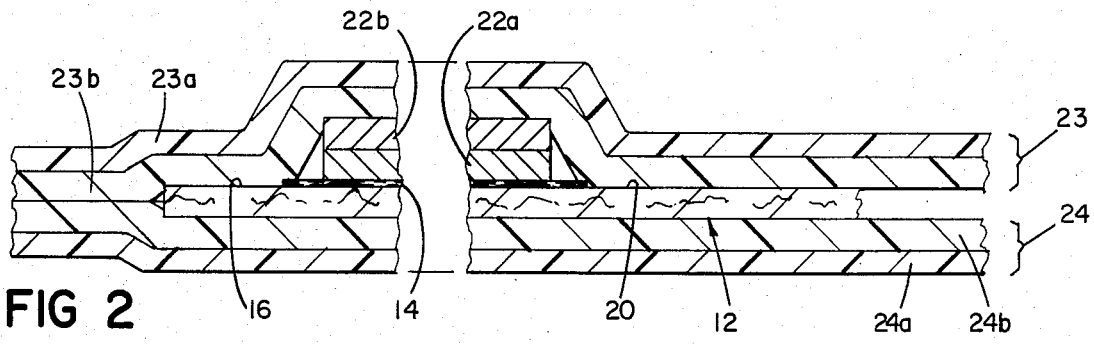
FIG 2
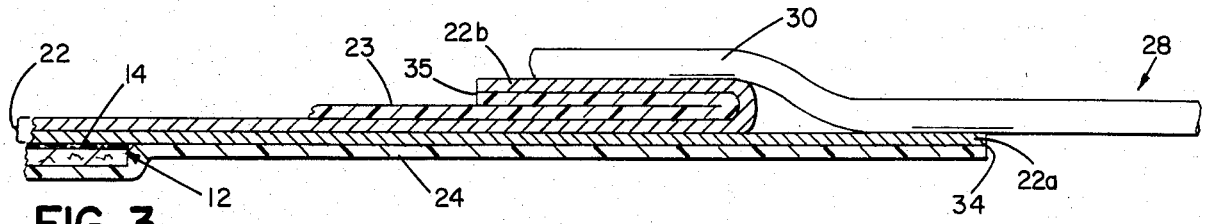
FIG 3

ELECTRICAL HEATING DEVICE

CROSS-REFERENCE TO RELATED APPLICATIONS

This application is a continuation-in-part of U.S. application Ser. No. 295,000 filed Aug. 21, 1981 and now U.S. Pat. No. 4,485,297 issued Nov. 27, 1984, which itself is a continuation-in-part of U.S. application Ser. No. 181,074, filed Aug. 28, 1980 and now abandoned.

This invention relates to electrical heaters.

BACKGROUND OF INVENTION

U.S. patent application Ser. No. 181,974, filed Aug. 28, 1981 and now abandoned and Ser. No. 295,400, filed Aug. 21, 1981, both of which are now owned by Flexwatt Corporation, the assignee of the present application, disclose a flexible sheet heater in which a semi-conductor pattern including a pair of longitudinally-extending stripes is printed on a substrate. A thin copper electrode is placed on each strip and is there held in place by a cover sheet that is attached, at opposite sides of the electrode, to closely-adjacent portions of the underlying substrate.

The present invention is directed to improvements in such sheet heaters.

SUMMARY OF INVENTION

I have discovered that the ability of such sheet heaters to flex without adversely effecting the electrical contact between the copper electrodes and the semi-conductor pattern is greatly improved if a pair of thin, rectangular-in-cross-section electrodes are placed, one on top of the other, on each semi-conductor strip.

I have discovered also that such a double electrode structure makes it possible simply and permanently to connect a wire to each electrode, even when the electrodes are tightly sealed between a pair of plastic insulating sheets.

DRAWINGS

FIG. 1 is a plan view of a sheet heater embodying the present invention.

FIG. 2 is a section, portions of which have been enlarged, taken at 2—2 of FIG. 1.

FIG. 3 is a section, portions of which have been enlarged, taken at 3—3 of FIG. 4.

FIG. 4 is an enlarged view of portions of the heater of FIG. 1.

DETAILED DESCRIPTION

FIG. 1 illustrates a sheet heater, generally designated 10, comprising a substrate (typically paper or plastic) 12 on which is printed (typically by screening) an about 0.0005 inch thick semi-conductive pattern of colloidal graphite. Such semi-conductor patterns are described in detail in the above-referenced U.S. Patent Applications, both of which are here incorporated by reference.

As shown, the semi-conductor pattern includes a pair of parallel longitudinal stripes 14, each 5/32 inch wide, and a plurality of identical, regularly-spaced semi-conductor bars 18 extending between stripes 14. Each bar 18 is $\frac{1}{4}$ inch wide measured perpendicularly to the edges of the bars, and thus somewhat longer than $\frac{1}{4}$ measured along the intersection between bars 18 and stripes 14, The substrate 12 on which the pattern is printed is of sufficient width to provide an uncoated boundary 16 (about 1/32 inch wide) along the outside edge of each stripe 14. The spaces 20 between adjacent bars 18, each about half as wide as a bar 18 (i.e., about $\frac{1}{8}$ inch wide), are also uncoated, i.e., are free from the semi-conductor pattern.

In the illustrated embodiment, the distance between stripes 14 is about 6 inches. Each of bars 18 is in the form of a chevron, each straight line segment 18*a*, 18*b* of which extends angularly half the distance between the stripes and forms an angle, $\alpha$, of about 10° with a line extending perpendicularly between stripes 14. The included angle between segments 18*a*, 18*b* is, thus, about 160°. In embodiments in which the distance between stripes 14 is less than about $4\frac{1}{2}$ inches, each bar typically will comprise a single straight line segment extending the full distance between stripes 14.

A pair of tin-plated copper electrodes 22*a*, 22*b*, each typically $\frac{1}{8}$ inch wide and 0.003 inch thick, is placed on top of each longitudinal stripe 14 with electrode 22*a* engaging the underlying stripe 14 and an electrode 22*b* on top of electrode 22*a* with the upper surface of electrode 22*a* and the lower surface of electrode 22*b* in face-to-face engagement with each other. The two electrodes 22*a*, 22*b* of each pair are not attached to each other and, except to the extent they are restrained by other portions of the laminate, are free to slide relative to each other.

Substrate 12, the graphite pattern printed thereon, and electrodes 22 are hermetically sealed between a pair of thin plastic sheets 23, 24. Each of sheets 23, 24 is a co-lamination of a 0.002 inch thick polyester ("Mylar") dielectric insulator 23*a*, 24*a* and a 0.003 inch thick polyethylene adhesive binder 23*b*, 24*b*. Plastic adheres poorly to graphite, but the polyethylene layers 23*b*, 24*b* heat seal well to substrate 12 and to each other. The polyethylene layer 23*b* on top of substrate 12 bonds to both the uncoated paper boundary outside stripes 14 and, between stripes 14, to the uncoated substrate spaces 20 between adjacent bars 18. Stripes 14 are slightly wider than electrodes 22 to insure proper electrical connection between the electrodes and underlying stripes, but both this extra width and the distance from the stripes 14 to the side edges of the substrate are kept to a minimum so that the electrodes will be held tightly down on the stripes.

It will be noted that sheets 23, 24 are both wider and longer than substrate 12 and are tightly sealed to each other in the areas outside the longitudinal and transverse edges of substrate 12. Electrodes 22, however, extend the full length of heater 10. The fact that the transverse edges of the substrate 12 are spaced inwardly from the ends of the heater, coupled with the fact that the polyethylene layers 23*b*, 24*b* seal tightly around the periphery of the electrode portions in the areas between the transverse edges of the substrate 12 and the ends of the heater where there is no substrate, ensure that all the edges of the heater are effectively hermetically sealed.

Preferred apparatus for making the heater of the present invention is disclosed in my copending application Ser. No. 478,080, filed Mar. 23, 1983, which is here incorporated by reference. As there shown, the various layers of the heated are laminated, i.e., heat sealed, together by passing them between a pair of heated nip rolls. As shown in FIG. 2, the heat from the nip rolls partially melts the polyethylene layer 23*b* of sealing layer 23, causing the melted plastic to flow partially around the side edges of the top electrode 22*b*. The polyethylene layer 23 seals to the top electrode 22*b*, to the uncoated boundary space 16 along one edge of electrode 22, and to the uncoated space 20 between adjacent bars 18 at the other edge of electrode 22. It also bonds, but only lightly, to the semi-conductor portion, e.g., to the exposed portions of the upper surfaces of stripes 14 and to the top of bars 18. The pressure of the nip rolls also forces the bottom electrode **22*a* slightly down into paper substrate 12, and the slightly compressed paper acts somewhat as a spring, maintaining positive pressure between the engaged electrodes 22*a*, 22*b***.

Reference is now made to FIGS. 3 and 4 which illustrate the manner in which connecting wires 28 are attached to heater 10. At the end 34 of the heater 10 to which connection is to be made, a wedge-shaped portion 32 of the heater laminate, about ½ inch long and 3/16 inch wide at the end 34 of the heater, is cut out, and removed, along each side of each of electrodes 22. As indicated, one edge 33 of each cut-out extends longitudinally along a side edge of an electrode 22 (very close to or slightly within the electrode), thus breaking the seal between the tightly sealed together plastic sheets 23, 24 at the edge of the electrode and permitting the upper electrode **22*b* (and the portion of sealing layer 23 on top of it) to be folded back upon itself. The upper electrode 22*b* and overlying sealing layer 23 are folded back so that their free end 35 is located about ⅜ inch from the edge 34 of heater 10, thus exposing an about ⅜ inch long strip of electrode 22 (formed, as shown in FIG. 3, by a 3/16 inch length of the exposed top of electrode 22*a* and an equal length of the exposed bottom surface of folded-back electrode 22*b*) to which the stripped end 30 of connecting wire 28 is soldered. It is important to note that the total length of exposed electrode (about ⅜ inch) is shorter than the length (½ inch) of the removed wedge 32. This permits an electrically insulating sleeve 36 to be slipped over, and cover, the entire connection area. As shown in FIG. 1, sleeve 36 is positioned with its end abutting the inner ends 38 of the cut-out portion 32 on each side of electrode 22 and heat shrunk to hold it in place. For clarity, sleeve 36** is not shown in FIGS. 1A and 3.

At the other end 48 of heater 10, a elongated hole 50 about ¼ inch wide is punched through each electrode 22 and the superposed, sealed-together sheets 13, 14 at a point a short distance from end 48, i.e., between heater end 48 and the adjacent end of substrate 12. The plastic around the edge of the holes 50 is melted, using a conventional spot heater, to cause plastic to flow over and seal the ends of the conductors 22. As will be apparent, this both insures that the ends of conductors 22 at heater end 48 are not "live", and also maintains the desired water-tight seal around the entire heater periphery.

Other embodiments will be within the scope of the following claims.

What is claimed is:

1. An electrical heating device comprising an elongated conductor, a semi-conductor pattern electrically connected to and extending from said conductor, and electrically insulating sealing layers on top of and below said conductor and said semi-conductor pattern, said device being characterized in that:

said conductor comprises a pair of rectangular in cross-section metallic conductor elements, placed one on top of the other in face-to-face engagement with and unattached to each other, the bottom one of said conductor elements facing towards one of said sealing layers and the upper one of said conductor elements facing towards and engaging the other of said sealing layers, the upper one of said conductor elements adjacent an end of said device is folded back longitudinally upon itself to expose an upper surface of the lower one of said conductor elements and a lower surface of the upper one of said conductor elements, and a wire engages and is electrically connected to at least one of the thus exposed upper surface of said lower one of said conductor elements and the thus exposed lower surface of said upper one of said conductor elements.

2. The heating device of claim 1 wherein said device comprises two of said conductors spaced apart from and parallel to each other, and said semi-conductor pattern is electrically connected to and extends between said two conductors.

3. The heating device of claim 1 wherein said semi-conductor pattern includes a stripe extending longitudinally of said device, and wherein said conductor overlies said stripe with the bottom one of said pair of conductor elements engaging said stripe in face-to-face engagement.

4. The heating device of claim 3 wherein stripe has a width not more than slightly greater than the width of said bottom one of said conductor elements.

5. The heating device of claim 1 wherein said sealing layer is heat sealed to said substrate and to the upper one of said pair of conductor elements.

6. The heating device of claim 5 wherein said sealing layer comprises a co-lamination including a layer of polyethylene facing towards said substrate and said conductor, and said polyethylene layer of said sealing layer is heat sealed to said substrate and to the upper one of said conductor elements.

7. The heating device of claim 1 wherein said sealing layers extend longitudinally of said device beyond at least one end of said substrate and are sealed to each other in the area between said one end and the adjacent end of said heater, and said conductor extends from said substrate through said area to said adjacent end of said heater.

8. The heating device of claim 1 wherein said wire is electrically connected to both of said conductor elements of said conductor.

9. An electrical heating device comprising an elongated conductor, a semi-conductor pattern electrically connected to and extending from said conductor, and electrically insulating sealing layers on top of and below said conductor and said semi-conductor pattern, said device being characterized in that:

said conductor comprises a pair of rectangular in cross-section metallic conductor elements, placed one on top of the other in face-to-face engagement with and unattached to each other, the bottom one of said conductor elements facing towards one of said sealing layers and the upper one of said conductor elements facing towards and engaging the other of said sealing layers, the upper one of said conductor elements adjacent an end of said device is folded back longitudinally upon itself to expose an upper surface of the lower one of said conductor elements and a lower surface of the upper one of said conductor elements, a wire engages and is electrically connected to at least one of the thus exposed upper surface of said lower one of said conductor elements and the thus exposed lower surface of said upper one of said conductor elements, portions of said sealing layers adjacent said end of said device and at each side of said conductor are removed to provide cut out areas one edge of each of which is closely adjacent a side of said conductor, thereby facilitating folding-back of the portion of said upper one of said conductor elements intermediate said cut-out areas.

10. The heating device of claim 9 including an electrically-insulating sleeve surrounding the said folded-back portion of said upper one of said conductor elements, the portion of said lower one of said conductor elements, having said exposed upper surface, and the portion of said wire engaging said conductor.

11. An electrical heating device comprising an electrically insulating substrate, an elongated conductor extending longitudinally of said substrate, a semi-conductor pattern carried on said substrate and electrically connected to and extending from said conductor and, electrically insulating sealing layers on top of and below said conductor and sealed to each other at opposite sides of said conductor, said device being characterized in that:

said conductor comprises a pair of rectangular in cross-section metallic conductor elements, placed one on top of the other in face-to-face engagement with and unattached to each other, the bottom one of said conductor elements facing towards said substrate and the upper one of said conductor elements facing towards and engaging said sealing layer, said sealing layers extend longitudinally of said device beyond at least one end of said substrate and are sealed to each other in the area between said one end and the adjacent end of said device, said conductor extends from said substrate through said area to said adjacent end of said device, and the upper one of said conductor elements adjacent said adjacent end is folded back longitudinally upon itself to expose an upper surface of the lower one of said conductor elements and a lower surface of the upper one of said conductor elements, and a wire engages and is electrically connected to at least one of the thus exposed upper surface of said lower one of said conductor elements and the thus exposed lower surface of said upper one of said conductor elements.

12. The heating device of claim 11 wherein said wire engages said exposed upper surface of said lower one of said conductor elements and said exposed lower surface of said upper one of said conductor elements.

13. An electrical heating device comprising an electrically insulating substrate, an elongated conductor extending longitudinally of said substrate, a semi-conductor pattern carried on said substrate and electrically connected to and extending from said conductor, and electrically insulating sealing layers on top of and below said conductor, said device being characterized in that:

said conductor comprises a pair of rectangular in cross-section metallic conductor elements, placed one on top of the other in face-to-face engagement with and unattached to each other, the bottom one of said conductor elements facing towards said substrate and the upper one of said conductor elements facing towards and engaging said sealing layer, said sealing layers extend longitudinally of said device beyond at least one end of said substrate and are sealed to each other in the area between said one end and the adjacent end of said device, said conductor extends from said substrate through said area to said adjacent end of said device, and portions of said sealing layers adjacent said adjacent end of said device are removed to provide cut-out areas one edge of each of which is closely adjacent a side of said conductor, thereby facilitating folding-back of the portion of said upper one of said conductor elements intermediate said cut-out areas.

14. The heating device of claim 13 including an electrically-insulating sleeve surrounding the said folded-back portion of said upper one of said conductor elements, the portion of said lower one of said conductor elements having said exposed upper surface, and the portion of said wire engaging said conductor element.

* * * * *